US005561913A

United States Patent [19]

Domoto

[11] Patent Number: 5,561,913

[45] Date of Patent: Oct. 8, 1996

[54] APPARATUS FOR DRYING PHOTO-SENSITIVE MATERIAL

[75] Inventor: Tatsuya Domoto, Wakayama, Japan

[73] Assignee: Noritsu Koki Co., Ltd., Wakayama, Japan

[21] Appl. No.: 525,102

[22] Filed: Sep. 8, 1995

[30] Foreign Application Priority Data

Sep. 13, 1994 [JP] Japan ..... 6-219133

[51] Int. Cl.[6] ..... F26B 11/02

[52] U.S. Cl. ..... 34/114; 34/122; 34/130; 34/670

[58] Field of Search ..... 34/114, 122, 130, 34/595, 135, 145, 620, 236

[56] References Cited

U.S. PATENT DOCUMENTS 4,693,016 9/1987 Yamazaki et al. ..... 34/122

5,079,853 1/1992 Kurokawa ..... 34/114

*Primary Examiner*—John M. Sollecito
*Assistant Examiner*—Steve Gravini
*Attorney, Agent, or Firm*—Armstrong, Westerman, Hattori, McLeland & Naughton

[57] ABSTRACT

An apparatus for drying photo-sensitive material having a transfer path for the photo-sensitive material having at least one curved section, a supply device for supplying hot air to the photo-sensitive material, and a suction duct for sucking the hot air provided inside the curved section. The apparatus further includes turn rollers provided along the inside of the curved section, and a paper guide having an opening for circulating hot air, provided between the adjacent two rollers of the plurality of turn rollers in such a manner as not to contact with the photo-sensitive material. It is possible to dry all the portions of the photo-sensitive material under a uniform condition, while maintaining the transfer characteristics so that no drying irregularity appears; thereby, making it possible to prevent the reduction in the printing quality of the picture due to the drying irregularity.

2 Claims, 5 Drawing Sheets

APPARATUS FOR DRYING PHOTO-SENSITIVE MATERIAL

BACKGROUND OF THE INVENTION

This invention relates to an apparatus for drying photo-sensitive-material, and more particularly, to an apparatus for drying photo-sensitive material with which, after a photo-sensitive material such as silver halide photo-sensitive material (hereinafter called as photo-sensitive material) is developed and fixed with a wet method, the photo-sensitive material is dried.

A conventional apparatus for drying photo-sensitive material (hereinafter called as drying apparatus) includes, as shown in FIGS. 4 and 5, a transfer path 31 having a curved lower turn section 31*a*, a supply means 32 for supplying hot air provided outside the lower turn section 31*a*, and a suction duct 33 for sucking the hot air provided inside the lower turn section 31*a*. A drum-shaped lower roller 34 is rotatably arranged inside the lower turn section 31*a*.

The lower roller 34 consists of a short column 34*a* on which outer circumference is bonded a foamed silicone layer 34*c*, and a plurality of disks 34*b* provided on the both sides of the column 34*a* with a suitable interval. The disk 34*b* is made of polyacetal (polyoxymethylene) and the like. Moreover, the short column 34*a* and disk 34*b* are fixed to a common rotation shaft (not shown).

In this drying apparatus, the lower roller 34 is rotated by using a motor and the like to transfer a photo-sensitive material 35. Moreover, the direction of the front side and rear side of the photo-sensitive material 35 is determined so that the surface of the emulsion of the photo-sensitive material faces to the outside of the lower turn section 31*a*. Furthermore, the hot air supplied from the supply means 32 is blown towards the outside of the photo-sensitive material 35 (emulsion surface) to dry the photo-sensitive material 35. The hot air blown towards the outside of the photo-sensitive material 35 is sucked into the suction duct 33 through the gap between adjacent two disks 34*b* of the lower roller 34, thereby allowing the photo-sensitive material 35 to be sucked to the lower roller 34.

Especially, the center portion of the photo-sensitive material 35 contacts with the foamed silicone layer 34*c* on the outer circumferential surface of the short column 34*a* so that it is possible to transfer the photo-sensitive material 35 without causing failure such as slippage.

However, in the above-mentioned drying apparatus, the photo-sensitive material 35 passing through the lower roller 34 is apt to be dried easily at the part contacting with the outer circumferential surface of the short column to 34*a* or disk 34*b* because of easy heat transmission. On the other hand, the photo-sensitive material is apt not to be dried easily at the part other than that, namely, at the part passing through the gap between the adjacent two disks 34*b*. Moreover, there exist two kinds of materials, i.e. the foamed silicon layer 34*c* and POM (polyacetals) on the contacting surface with the photo-sensitive material so that the degree of drying varies with the difference of the material. Therefore, the degree of drying of the photo-sensitive material after being dried is not uniform at any position, thereby producing stripe-shaped drying irregularity. Drying irregularity reduces the quality of the picture print which would be finally obtained.

The present invention is made to solve the above problems, and accordingly it is an object of the present invention to provide a drying apparatus capable of preventing the generation of drying irregularity of the photo-sensitive material while maintaining easy transfer characteristics.

SUMMARY OF THE INVENTION

In accordance with the present invention, there is provided an apparatus for drying photo-sensitive material comprising a transfer path for the photo-sensitive material having at least one curved section, a supply means for supplying hot air to the photo-sensitive material, and a suction duct for sucking the hot air provided inside the curved section, wherein the apparatus further includes a plurality of turn rollers provided along the inside of the curved section, and a paper guide having an opening for circulating hot air, provided between the adjacent two rollers of the plurality of turn rollers in such a manner as not to contact with the photo-sensitive material.

It is desirable that the turn roller is equipped with a tube made of foamed silicone on a surface of a rotation shaft thereof.

According to the present invention, the photo-sensitive material is transferred with being guided along the transfer path by means of turn rollers and a paper guide arranged along the transfer path when drying the photo-sensitive material. Along with that, the photo-sensitive material is dried with hot air supplied from the supply means. The hot air passing through the photo-sensitive material is sucked into the suction duct through the opening formed on the paper guide.

The photo-sensitive material being dried contacts with the rollers along the entire width of the photo-sensitive material but does not contact with the paper guide. Therefore, it is possible to dry all the portions of the photo-sensitive material under a uniform condition, thereby causing no drying irregularity on the photo-sensitive material.

DETAILED DESCRIPTION

Figure 1:
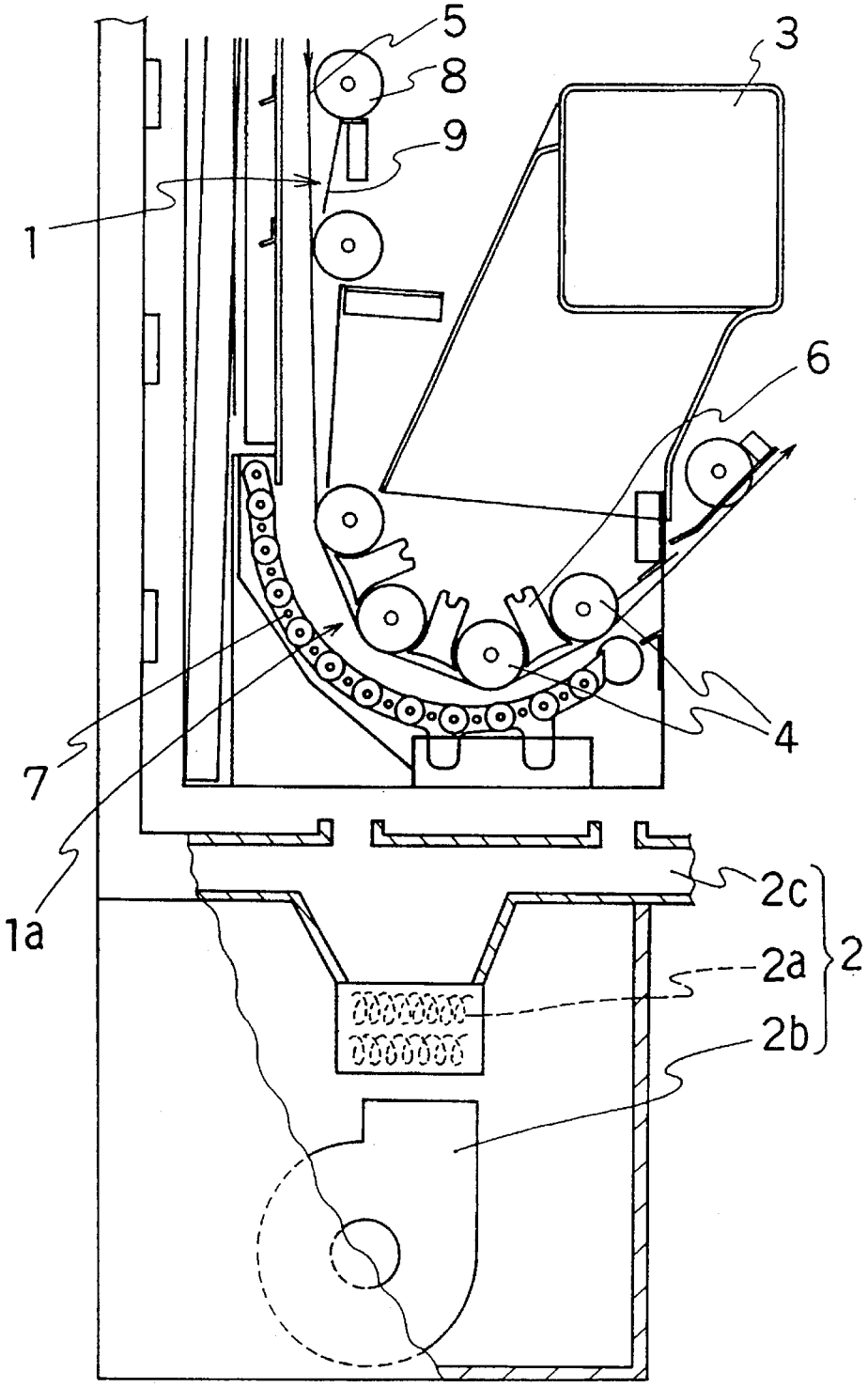
FIG. 1 is a front view showing an embodiment of a drying apparatus of the present invention.

The drying apparatus of the present invention is explained in detail with reference to the accompanying drawings. FIG. 1 is a front view showing an embodiment of the drying apparatus of the present invention, FIG. 2 is a perspective view showing the main section of the drying apparatus in FIG. 1, and FIG. 3 is a perspective view showing the paper guide in FIG. 1.

Figure 2:
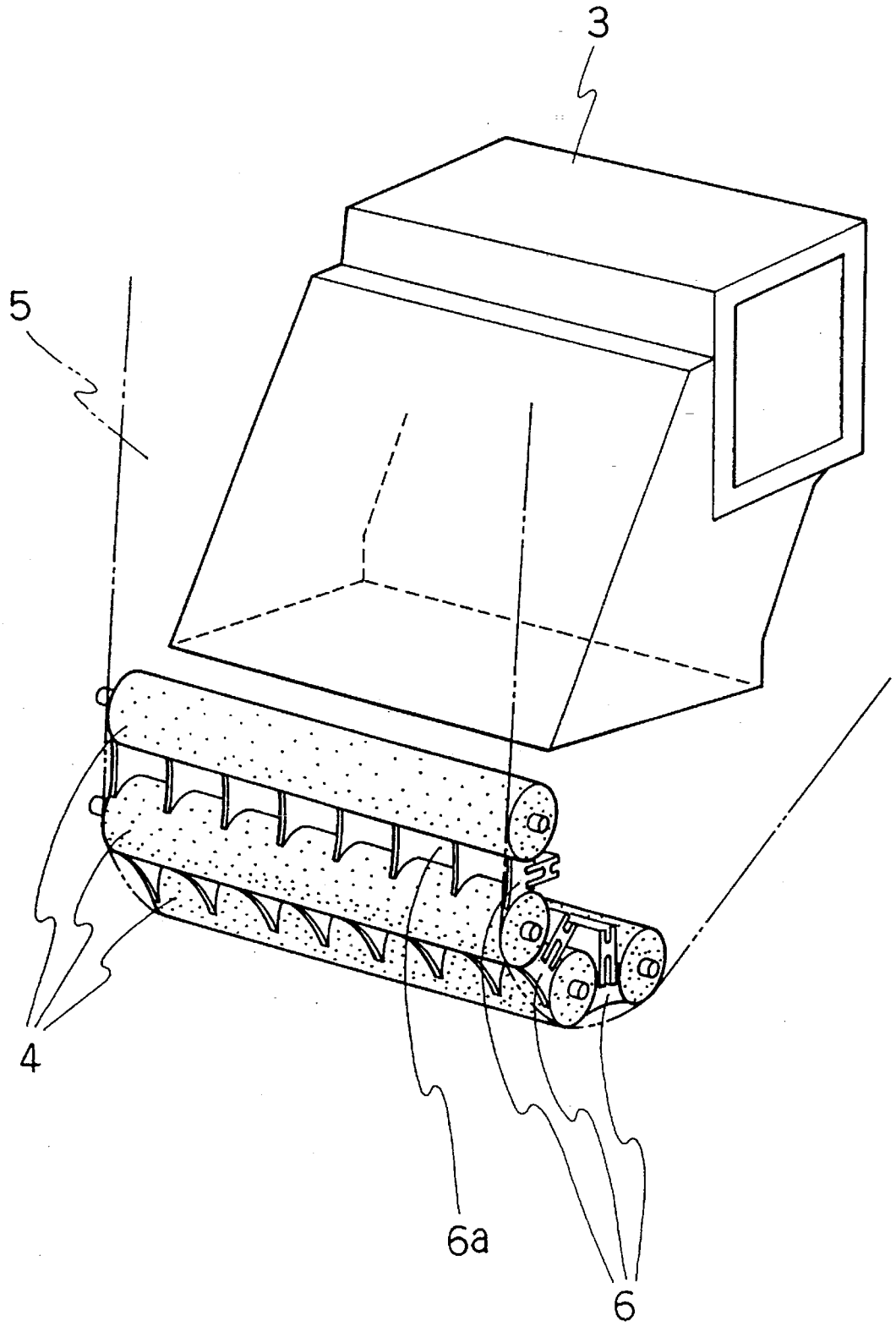
FIG. 2 is a perspective view showing a main section of the drying apparatus in FIG. 1.
Figure 3:
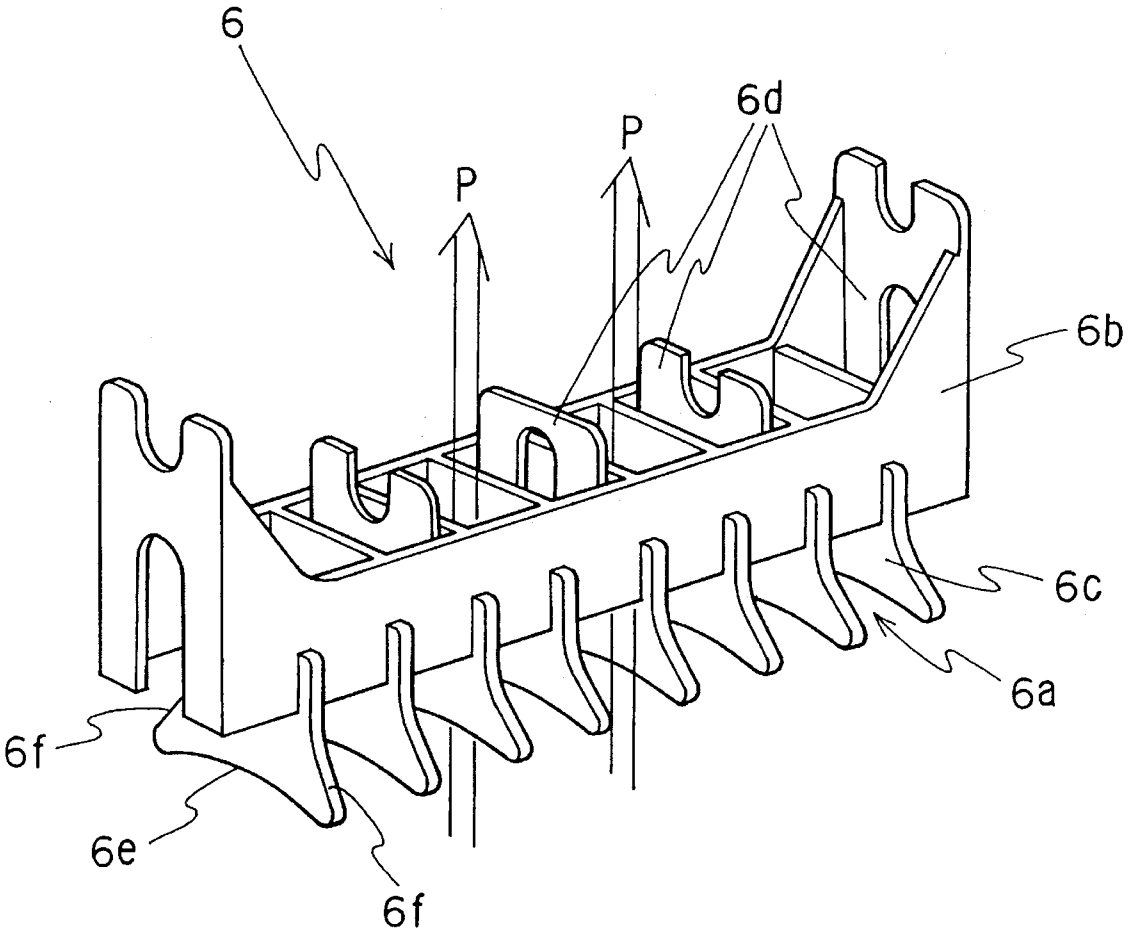
FIG. 3 is a perspective view showing the paper guide in FIG. 1.
Figure 4:
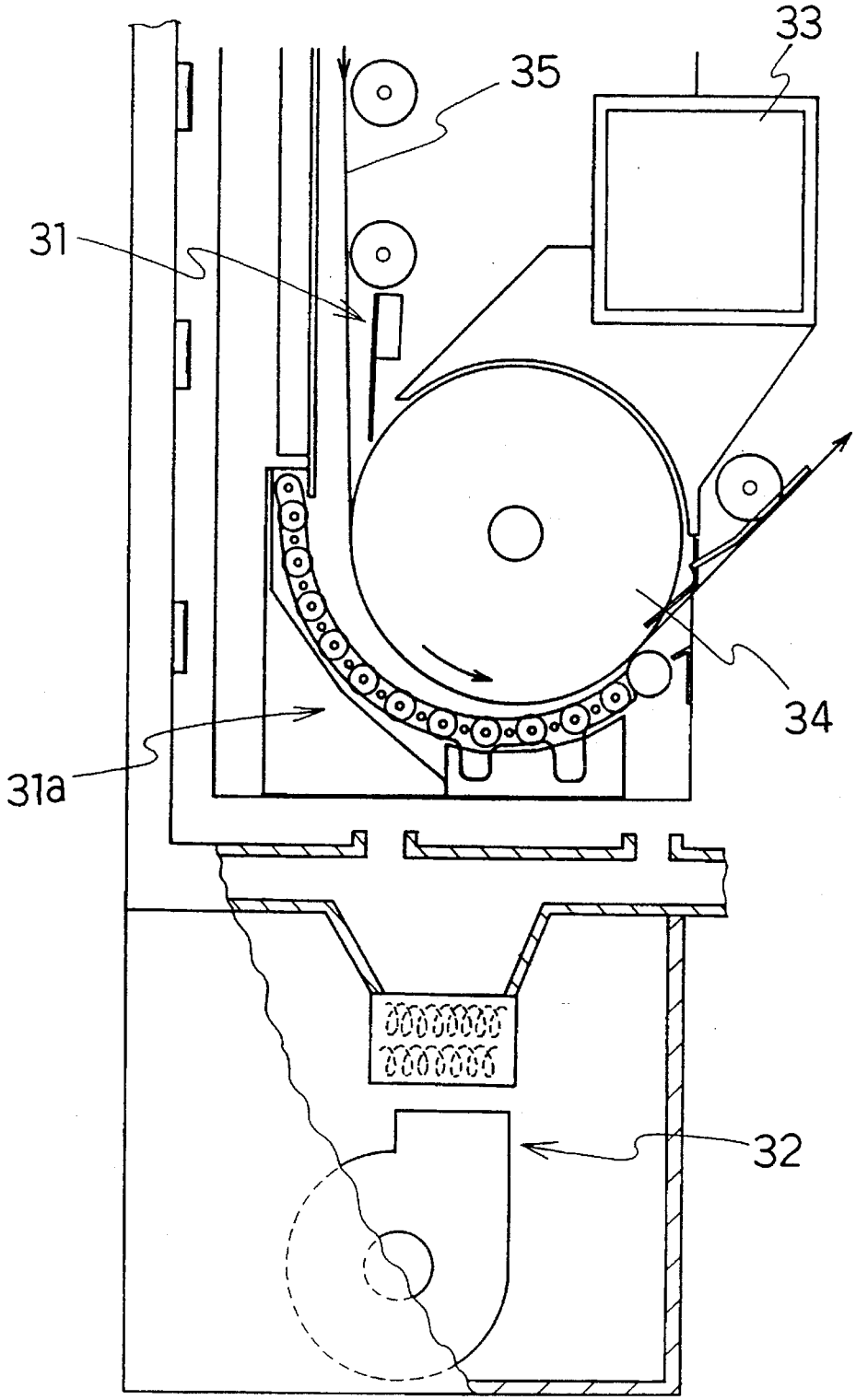
FIG. 4 is a front view showing a conventional drying apparatus.
Figure 5:
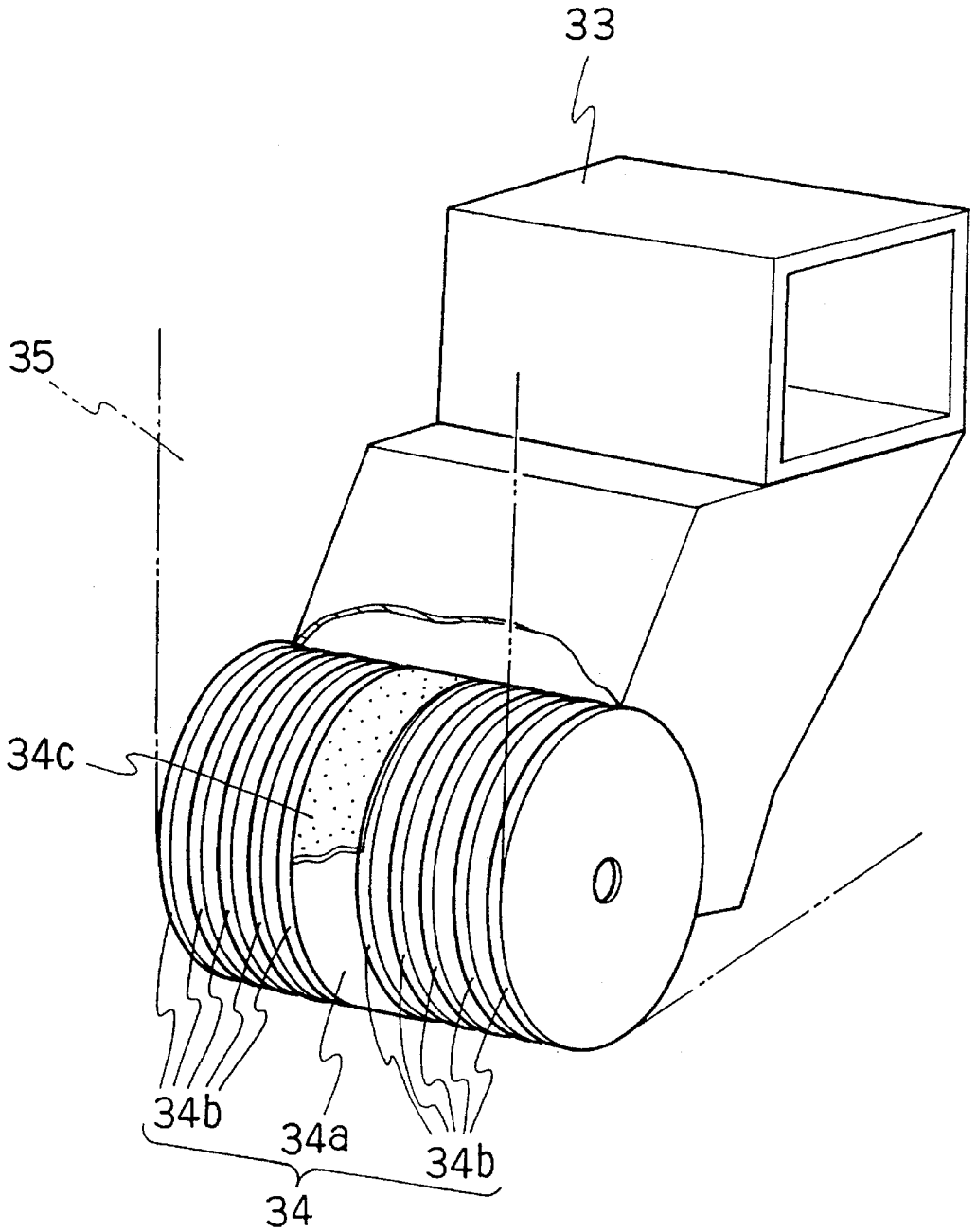
FIG. 5 is a perspective view showing a main section of the drying apparatus in FIG. 4.

The drying apparatus shown in FIGS. 1 and 2 have a transfer path 1 with a curved lower turn section 1*a*, a supplying means 2 for supplying hot air provided outside the lower turn section 1*a*, and a suction duct 3 for sucking the hot air provided inside the lower turn section 1*a*. In addition, the drying apparatus includes a plurality of turn rollers 4 provided along the inside of the lower turn section 1*a*, and a paper guide 6 having an opening 6*a* for circulating the hot air provided between the adjacent two rollers of the plurality of turn rollers 4 in such a manner as not to contact with the photo-sensitive material 5. Moreover, 7 indicates a roller provided outside the lower turn section 1*a*, and 8 and 9 respectively indicate a transfer roller and a guide plate provided along the straight section of the transfer path 1 at suitable intervals.

The supplying means 2 comprises a heater 2*a*, a blower 2*b* for forcibly supplying the air heated by the heater 2*a* and a duct 2*c* for distributing the hot air via the heater 2*a* to supply it to the photo-sensitive material 5.

As turn roller 4, there is used a cylindrical one having a relatively small diameter, for example about 35.6 mm. It is desirable to adopt a roller wherein a tube made of, for example, a foamed silicone with a thickness of about 13.8 mm is directly bonded on the surface of a rotation shaft because it offers a surface conditions suitable for transferring a photo-sensitive material, favorable dimensional accuracy, and less thermal contraction.

The tube made of foamed silicone is manufactured by bonding the silicone tube to the shaft after the foamed silicone is formed into a tube-shape, and polishing the outer surface of the tube.

Moreover, the paper guide 6 is made of PPE (polyphenyleneether), etc., and, as shown in FIG. 3, is provided with a plurality of fins 6*c* for restricting the direction of the flow of hot air (an arrow P in Figure) inside the main body 6*b*, which is a hollow body and opened upward and downward, at suitable intervals. The fin 6*c* has a dent section 6*e* gauged out in an arc shape on the lower section so as not to contact with the photo-sensitive material 5 passing through the transfer path 1. Moreover, both side section 6*f* of the fin 6*c* are formed in a curved shape to fit with the outside shape of the turn roller 4. An engaging section 6*d* is provided on the upper section of the paper guide 6 so as to engage with the fixed shaft (not shown) provided on the inner wall of the casing of the drying apparatus.

When a wet photo-sensitive material is dried by using thus configured drying apparatus after a wet processing such as developing, firstly, rotating the turn rollers 4 and 8 with a motor would result in that the photo-sensitive material 5 is transferred along the transfer path 1, being guided with a turn roller 4, roller 7, roller 8, and guide plate 9.

Moreover, the photo-sensitive material 5 is dried by supplying hot air from the supplying means 2 at the same time the photo-sensitive material is transferred. Moreover, the hot air is sucked into the suction duct 3 through the opening 6*a* provided on the paper guide 6 inside the lower turn section 1*a*. Therefore, the air pressure is reduced inside the lower turn section 1*a* compared with outside so that it is possible to transfer the photo-sensitive material 5 in a favorable state because the photo-sensitive material closely contact with the turn roller 4 side due to the difference in the inside and-outside pressure of the lower turn section 1*a*.

Moreover, the photo-sensitive material 5 uniformly contact with the turn roller 4 along all the width of the photo-sensitive material 5, however, the lower portion of the paper guide 6 does not contact with the photo-sensitive material since it is set back to the inside of the lower turn section 1*a*. Therefore, it is possible to dry all the portions of the photo-sensitive material under a uniform condition.

Moreover, in this embodiment, a dent section is formed on the fin of the paper guide so that the photo-sensitive material does not contact with the fin. However, the present invention is not limited to this, and it is acceptable that the fin is simply shortened or the whole paper guide is arranged separately from the transfer path.

According to the present invention, it is possible to dry all the portions of the photo-sensitive material under a uniform condition while maintaining the transfer characteristics so that no drying irregularity appears, thereby making it possible to prevent the reduction in the printing quality of the picture due to the drying irregularity.

Though several embodiments of the present invention are described above, it is to be understood that the present invention is not limited only to the above-mentioned and various changes and modifications may be made in the invention without departing from the spirit and scope thereof.

What is claimed is:

1. An apparatus for drying photo-sensitive material, comprising a transfer path for the photo-sensitive material having at least one curved section, a supply means for supplying hot air to the photo-sensitive material, and a suction duct for sucking the hot air provided inside the curved section, wherein the apparatus further includes a plurality of turn rollers provided along the inside of the curved section, and a paper guide having an opening for circulating hot air, provided between the adjacent two rollers of the plurality of turn rollers in such a manner as not to contact with the photo-sensitive material, wherein the supply means is in a first side of the transfer path for the photo-sensitive material, while the paper guide having the opening for circulating hot air is in a second side of the transfer path, the first side being opposite the second side.

2. The apparatus of claim 1, wherein the turn roller is equipped with a tube made of foamed silicone on a surface of a rotation shaft thereof.

* * * * *